United States Patent [19]

Kojima

[11] Patent Number: 4,928,623

[45] Date of Patent: May 29, 1990

[54] VARNISH COATING MECHANISM

[75] Inventor: Yasutaka Kojima, Tokyo, Japan

[73] Assignee: Akiyama Printing Machine Manufacturing Company, Ltd., Tokyo, Japan

[21] Appl. No.: 243,806

[22] Filed: Sep. 13, 1988

[30] Foreign Application Priority Data

Apr. 26, 1988 [JP] Japan ..... 63-103488

[51] Int. Cl.[5] ..... B05C 1/02

[52] U.S. Cl. ..... 118/249; 118/46; 118/258; 118/261; 118/262

[58] Field of Search ..... 118/249, 258, 261, 262, 118/46

[56] References Cited

U.S. PATENT DOCUMENTS

| | | | |
|---|---|---|---|
| 3,245,377 | 4/1966 | Gettel | 118/249 |
| 3,738,265 | 6/1973 | Saueressig | 118/46 |
| 3,875,581 | 4/1975 | Yamashita et al. | 118/249 |
| 4,046,931 | 9/1977 | Innes et al. | 118/249 |
| 4,300,476 | 11/1981 | Jurascheck et al. | 118/249 |
| 4,357,896 | 11/1982 | Feldkämper | 118/249 |
| 4,372,244 | 2/1983 | Rebel | 118/46 |

FOREIGN PATENT DOCUMENTS

| | | | |
|---|---|---|---|
| 46-21107 | 6/1971 | Japan | 118/249 |
| 62-127478 | 6/1987 | Japan | 118/249 |

*Primary Examiner*—James C. Housel

*Attorney, Agent, or Firm*—Bauer & Schaffer

[57] ABSTRACT

A varnish scraper is fitted to a varnish applicator roller to scrape off extra varnish which has remained after the varnish has been supplied to a blanket drum. The scraped extra varnish is circulated to a varnish vessel for re-using.

4 Claims, 7 Drawing Sheets

VARNISH COATING MECHANISM

BACKGROUND OF THE INVENTION

The present invention relates to a coating mechanism for applying varnish in a leaf-type offset printing apparatus, and more particularly to a mechanicm for appyling a lustrous and uniform varnish coat to the printing surface.

In conventional varnish coating apparatus the layer of varnish on the roller surface becomes thinner after the varnish is applied to a blanket drum which, like the printing blanket drum, has two surfaces of print and non-print so that the varnish blanket drum is covered partially with varnish for the printed areas only. Usually aqueous varnish is used on printing surface to facilitate drying in an in-line method. As the amount of varnish on the roller surface is not maintained uniform, the lustrous surface on the printing cannot be produced precisely.

SUMMARY OF THE INVENTION

In accordance with the present invention, a varnish coating mechanism is provided for a leaf-type offset printing apparatus wherein the varnish layer on the roller surface is always maintained uniformly so that the printing surface is provided with a favorable luster.

As object of the present invention is to provide a varnish scraper fitted to a varnish applying roller in combination with a base roller, a varnish cutting roller, a varnish applying roller, and a blanket drum. Another object is to provide for the scraping of the extra varnish from the roller surface using a varnish scraping roller to circulate it back to a varnish vessel. A further object is to circulate the varnish collected in the varnish vessel by feeding it through a pump. In particular, the structure of the present invention includes:

1. A base roller, fitted between a varnish cutting roller and a varnish applying roller, cycled by the force of the varnish applying roller to take up the varnish from a varnish vessel for application to a blanket drum.

2. The varnish scraping blade is mounted on the tip of a blade pressing plate so as to cause the scraped varnish to be collected into the varnish vessel. The varnish scraping vessel is fitted between the frame members of the printing machine body so as to be freely removable.

3. A pump linked with a compressor to feed warm varnish from a varnish contained to the varnish vessel.

The present invention has the following advantages:

First, as the extra varnish can be scraped off with the varnish scraper, the amount of varnish supplied to the blanket drum can always be maintained uniformly;

Second, the scraped varnish can be re-collected in the varnish vessel and fed to the base roller again; and Third, the scraped varnish from the varnish vessel and the varnish from the varnish container can be mixed and circulated together.

Therefore, as previously described, the varnish on the roller is uniformly covered, and a favorable lustrous printing surface can be made.

DETAILED DESCRIPTION OF THE INVENTION

Figure 1:
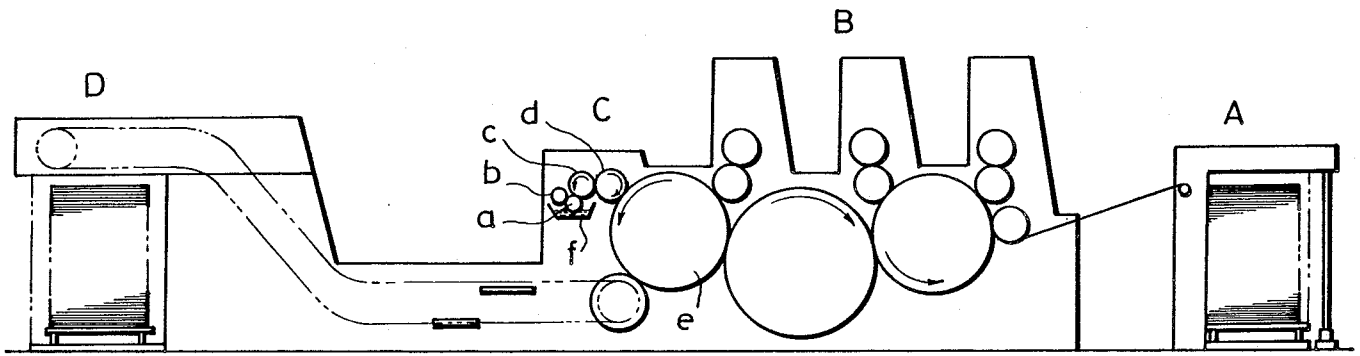
FIG. 1 is a side elevatioal view schematically showing a conventional varnish coating apparatus.

In FIG. 1 the conventional varnish coating mechanism for a leaf-type or sheet fed offset printing apparatus is shown wherein a paper sheet is fed from a feeding mechanism A to a printing section B having a plurality of print rollers. The varnish is applied to the printed surface of the paper at a varnish coating section C which comprises a supply of varnish f in which a base roller is partially immersed. The base roller a conveys the varnbish to a cutting roller b from which it is transferred to a varnish transfer roller c and subsequently to an applicator roller d. The varnished paper is then delivered to the paper discharging section D during which time it is dried.

According to the present invention a varnish scraper having a blade engaging with the varnish applicator roller is provided to remove the excess and/or remaining varnish not applied to the printed sheet.

Figure 2:
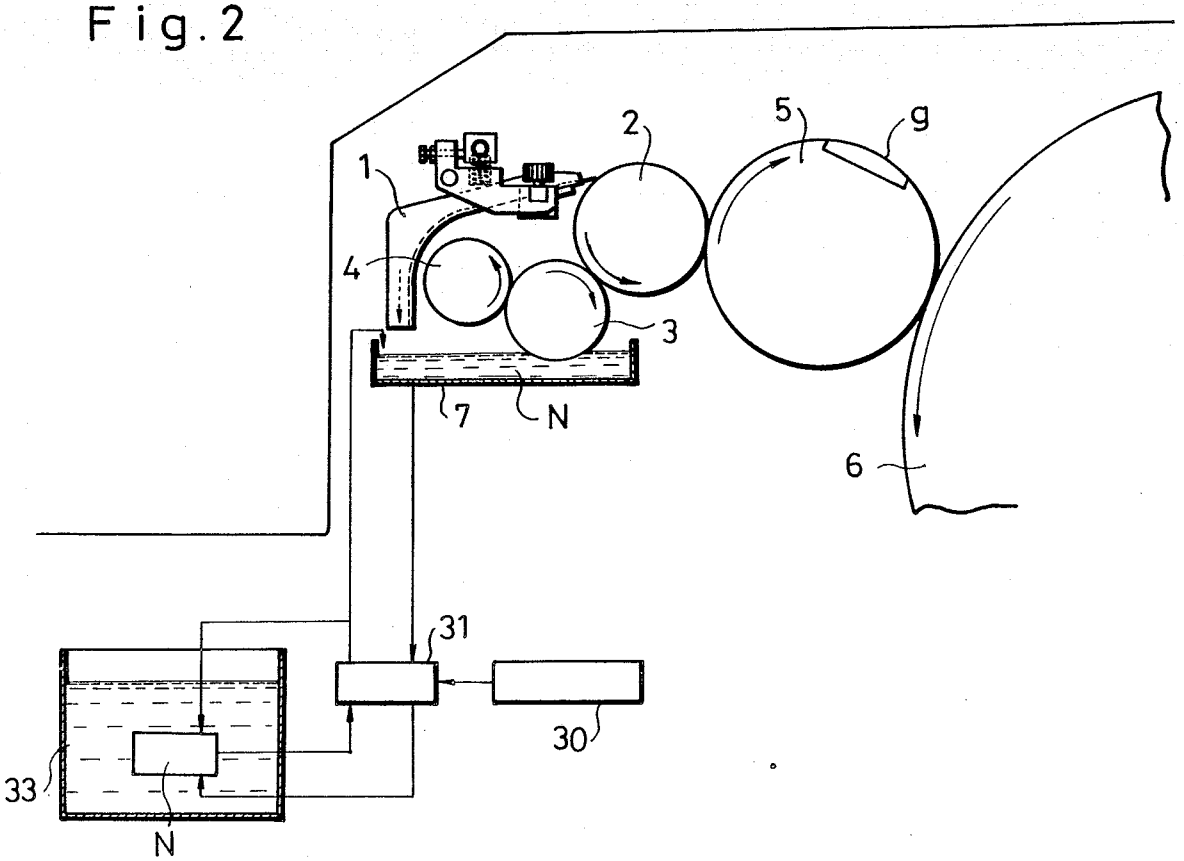
FIG. 2 is a side elevational view of a varnish coating mechanism for the present invention schematically showing its connection to a supply of varnish.
Figure 3:
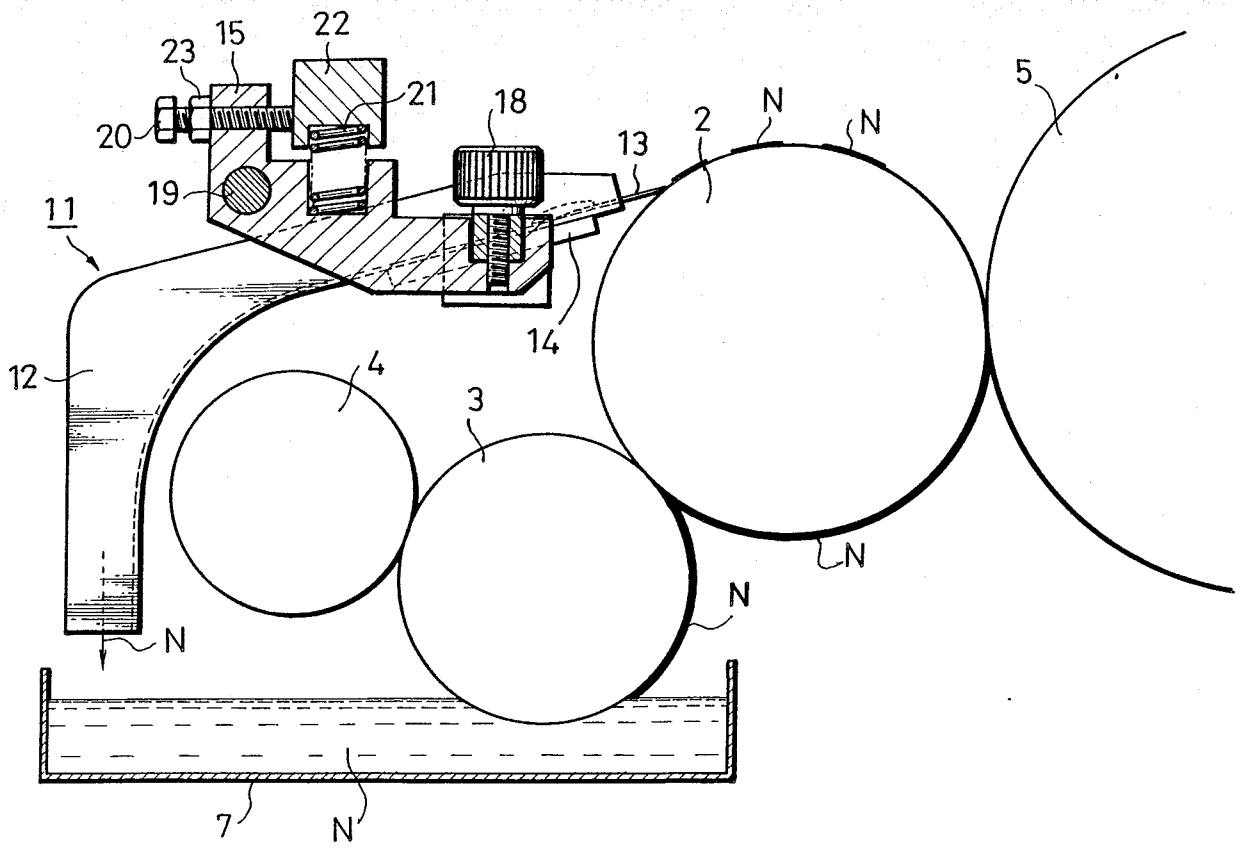
FIG. 3 is an enlarged view of the varnish scraper mechanism shown in FIG. 2.
Figure 4:
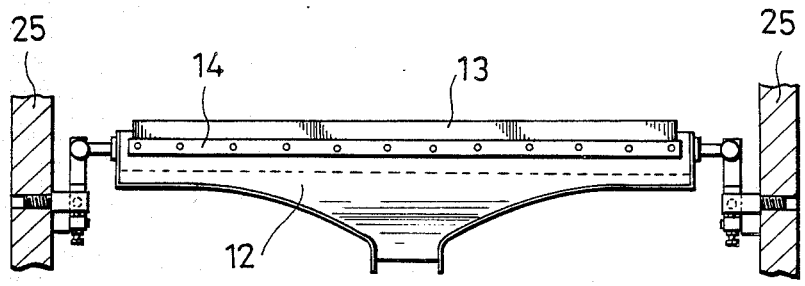
FIG. 4 is an enlarged plan view of the scraper shown in FIG. 3 mounted between opposed machine frame members.
Figure 5:
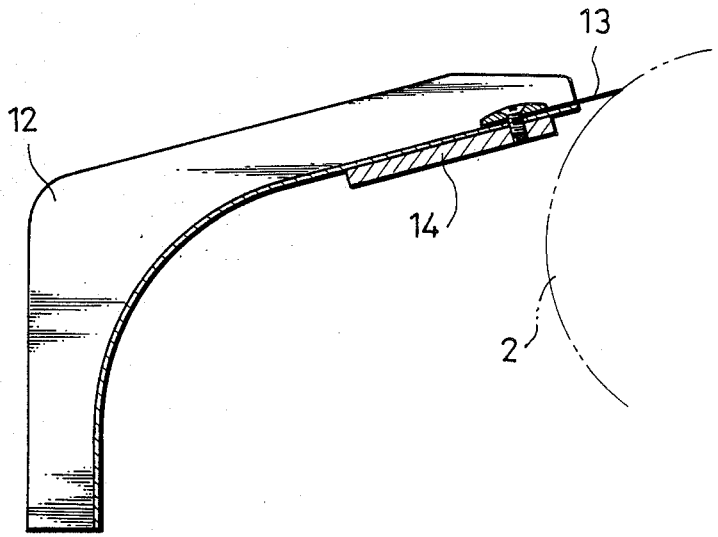
FIG. 5 is a sectional view of the scraper taken along line V—V of FIG. 4.
Figure 6:
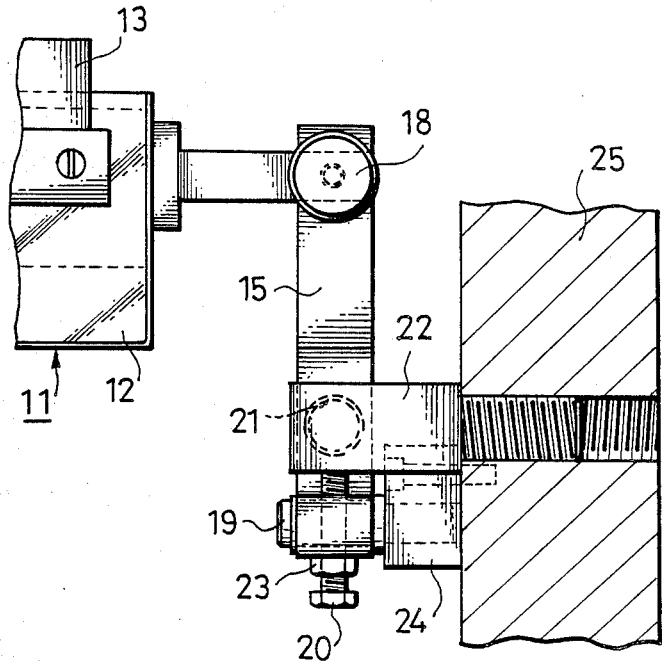
FIG. 6 is an enlarged view, particularly sectional of the scraper and mounting taken in the direction of arrow VI of FIG. 4.

As seen in FIG. 2 the varnish scraping mechansim of the present invention is applied to a printing apparatus such as shown in FIG. 1. In FIG. 2 a scraper assembly generally depicted by the numeral 1 is mounted in abutment with the upper surface of the applicator roller 2 and above a arnish vessel 7 in which a take-up roller 3 is partially immersed. The take-up roller 3 is also in engagement with the varnishing applicator roller 2. The applicator roller 2 abuts the blanket drum 5 which engages with the press drum 6 between which the paper is fed.

The applicator roller 2 applies varnish to the blanket drum in predetermined areas to be laminted onto the printed paper fed between the blanket drum and the press drum. Any excess varnish N not transferred to blanket drum 5 and remaining on the applicator roller 2 is scraped therefrom the scraper and passes through the scraper assembly 1 into the vessel 7 and is subsequently circulated via pump 31 operated by compressor 30 into a storage reservoir 33. Subsequently, the varnish is recirculated to the vessel 7 by operation of the pump 31.

The specific structure of the scraper assembly 1 is seen in FIGS. 3–7 wherein the scraper assembly, now depicted by the numeral 11, comprises a hollow funnel member 12 for passage of varnish having at its forward tip a scraper 13 adjustably held by a resilient pressing plate 14. The funnel member 12 is nearly L-shaped in a cross section and is arranged to allow the varnish to flow fromt he blade into the vessel 7 as indicated by the arrow.

Figure 7:
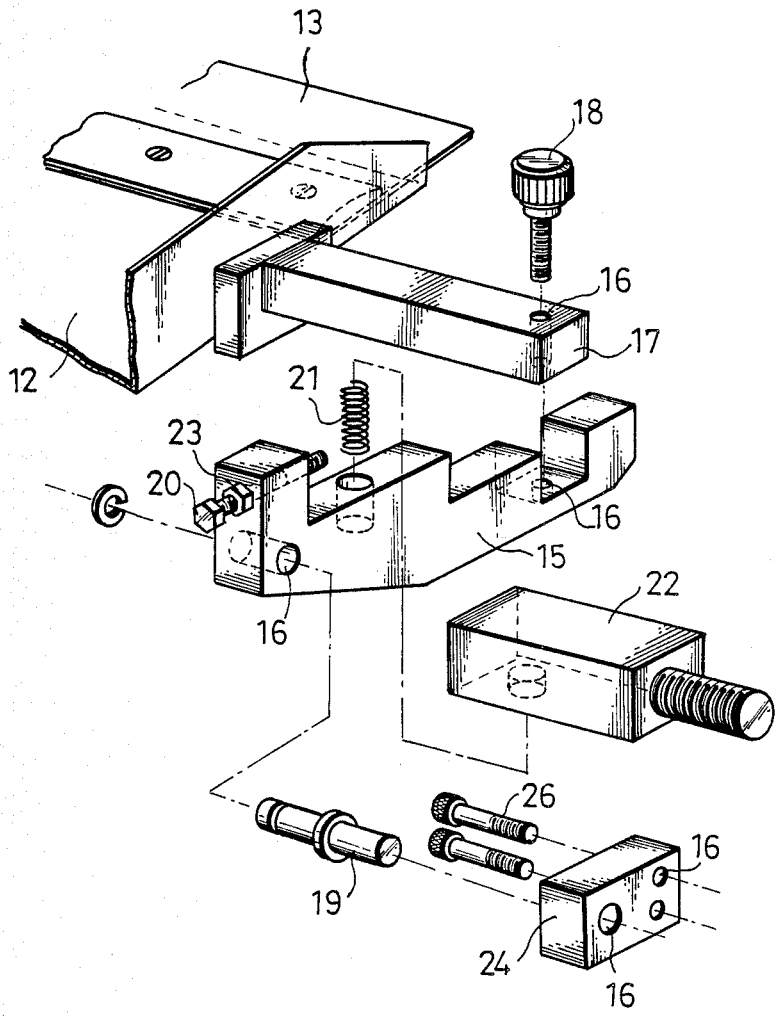
FIG. 7 is an exploded view of the mechanism shown in FIG. 6.

The funnel member 12 is mounted at each end on a supporting arm 5 which, as seen in FIG. 7, is provided with a saddle 16 at is forward end into which a rectangular finger 17, fixed to the side of the funnel 12, is inserted and removably held in place by a screw 18. At the rear end the arm 15 is mounted to pivot about a fulcrum pin 19 journal in a fixture 24 fixed by screws 26 to the side of an associated frame member 25.

Threadedly held by the frame 25 in a position above the fulcrum fixture 24 is a second fixture 22 which extends over the arm 15. A compression spring 21 is seated in a hole in the arm 15 and in a hole in the second fixture 22. An adjusting screw 20 extends through the arm 15 into engagement with the second fixture 22 and is provided with a nut 23 to secure it in place.

The control of contact pressure between the scraping blade 13 and the varnish applicator roller 2 depends on the operation of the supporting arms 15. If the adjusting screw 20 is screwed inwardly, i.e. clockwise, against the second fixture 22, the supporting arm 15 will go upward by pivoting counterclockwise about the fulcrum pin 19. The compression spring 21 will be further compressed, and the varnish scraping blade 13 will move resiliently away from the varnish applicator roller 2. Consequently, the contact pressure will be reduced. On the other hand, if the adjusting screw 20 is screwed counterclockwise, the compression spring 21 will be extended, and teh varnish scraping blade 13 will move closer to the varnish applicator roller 2, and therefore, the contact pressure will become higher.

Figure 8:
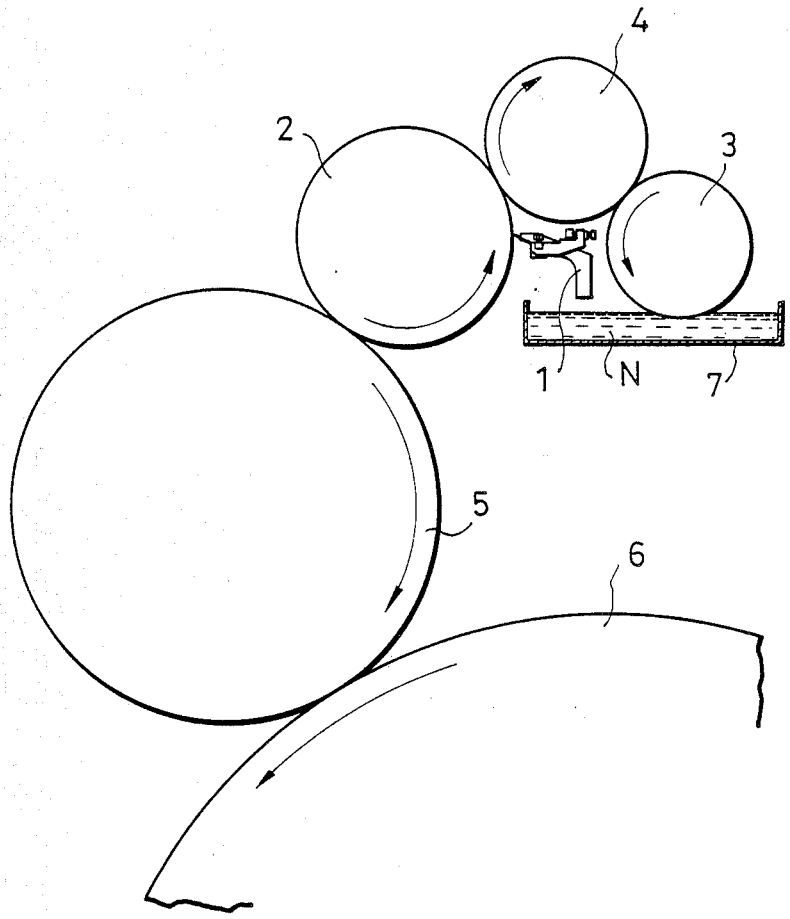
FIG. 8 is a view schematically showing a further embodiment of the varnish scraper.

In the further embodiment shown in FIG. 8 the scraper assembly 1 is fitted below to the varnish applying roller 2 as indicated in FIG. 2, and unlike the upward direction of scraping off in downward direction. In a word, the difference between FIG. 2 and FIG. 8 is only the direction of scraping. The operation and effects are otherwise exactly same.

I claim:

1. In an offset printer comprising a frame, a storage vessel, an applicator roller transferring varnish from the storage vessel to a blanket drum, the blanket drum transferring said varnish to a printed surface, the improvement comprising apparatus for scraping varnish from the applicator roller after the applicator roller has transferred varnish from the storge vessel to the blanket drum, said apparatus comprising a scraping blade, a support to which said scraping blade is mounted and means for mounting said support to the frame of said printer to resiliently bias said scraping blade in contact with said applicator roller for removing any remaining varnish from the applicator roller after transferring varnish to said blanket drum, said support comprising a vessel guiding the removed varnish from the applicator roller to said storage vessel whereby the scraped varnish is recycled.

2. The apparatus according to claim 1 wherein said means for mounting said support includes an adjusting screw regulating the contact pressure between said blade and said applicator roller.

3. The apparatus according to claim 1 wherein said guiding vessel comprises a hollow funnel shaped vessel and said support mounting means comprises a spring means for resiliently mounting said blade at a front end thereof.

4. The apparatus according to claim 1 wherein said means for mounting said support comprises a pair of arms pivotally attached respectively to opposing members of the frame and fixed at opposite sides of said support, a screw threaded into each of said arms having its free end bearing against a block attached to the frame whereby the position of each of said arms is adjustable.

* * * * *